United States Patent [19]

Brandberg et al.

[11] 4,038,425

[45] July 26, 1977

[54] COMBINED POPPING AND SHIPPING PACKAGE FOR POPCORN

[75] Inventors: Lawrence C. Brandberg; David W. Andreas, both of Minneapolis, Minn.

[73] Assignee: The Pillsbury Company, Minneapolis, Minn.

[21] Appl. No.: 508,963

[22] Filed: Sept. 25, 1974

[51] Int. Cl.[2] ..... B65D 77/14

[52] U.S. Cl. ..... 426/107; 229/3.5 MF; 229/DIG. 3; 426/111

[58] Field of Search ..... 426/107, 111, 112, 113, 426/115, 118, 122, 123, 234, 237, 241, 243, 392, 394, 396, 411, 412; 99/449, 451; 206/525, 527; 229/3.5 MF, 43, 66, DIG. 3; 220/46, 4 D

[56] References Cited

U.S. PATENT DOCUMENTS

| | | | |
|---|---|---|---|
| 2,480,679 | 8/1949 | Spencer | 426/106 |
| 2,528,251 | 10/1950 | Spencer | 426/110 X |
| 2,819,976 | 1/1958 | Hines | 426/111 |
| 2,865,768 | 12/1958 | Barnes et al. | 426/111 |
| 3,052,554 | 9/1962 | Colman | 426/111 |
| 3,519,439 | 7/1970 | Dunn | 426/111 |
| 3,784,087 | 1/1974 | Styers | 229/66 X |
| 3,851,574 | 12/1974 | Brandberg et al. | 426/111 X |
| 3,873,738 | 3/1975 | Zoeller et al. | 426/111 |

*Primary Examiner*—Frank W. Lutter
*Assistant Examiner*—William A. Cuchlinski, Jr
*Attorney, Agent, or Firm*—James V. Harmon; Michael D. Ellwein

[57] ABSTRACT

A combined popping and shipping package for popcorn is described. The package is composed of a dual compartmented container, one compartment being relatively small and containing the charge of popcorn and fat ready to be popped. The larger compartment which is expansible communicates with the small compartment and is adapted to hold the popped kernels.

8 Claims, 10 Drawing Figures

COMBINED POPPING AND SHIPPING PACKAGE FOR POPCORN

FIELD OF THE INVENTION

The invention relates to combination popping and shipping containers for popcorn.

THE PRIOR ART

Presently available containers used for distributing and popping a single serving of popcorn are unsatisfactory for popping the corn in microwave ovens of the kind used in the home. These ovens have a relatively low power output, usually between about 450 to 700 watts. The general objective of the invention is to find a way to package the corn so that it will pop effectively in ovens of this size. The primary problem is that it is necessary to keep the oven on for a very long period and before a substantial percentage of the kernels pop and during this time the popped corn becomes burned or scorched. The popped kernels are particularly susceptible to scorching. Moreover, a substantial amount of the corn remains unpopped. In the development of the present invention, attempts were made to pop corn in a relatively tall carton having a rectangular cross section somewhat like a one-quart paperboard milk carton. The corn and fat were placed in the bottom of the carton prior to popping. There were two major problems in this approach. The first is that the container was so large and bulky it increased shipping costs. The other problem was that the corn, once it popped, tended to expand and to become jammed in the lower part of the carton where burning took place.

A paper bag was also tried and found unsatisfactory in ovens of from about 450–700 watts capacity. The final popped volume of the corn was relatively poor and totally unsatisfactory. In addition, a large number of old maids remained. When heating was continued to try to pop the remaining kernels, the popped kernels began to scorch. An expanding box having folded pleats somewhat like an accordian was also tried but was found unsatisfactory.

THE OBJECTS

The main objects are to provide a) combined shipping and storage package for popcorn that is effective in microwave ovens of less than about 700 watts capacity and specifically one that will provide popped corn volume of at least 1800 c.c. when a starting charge of 100 grams is used comprising 68 grams of popcorn, 27 grams of fat such as hydrogenated coconut oil and 5 grams of salt, b) a package which will allow more kernels to pop in less time with substantially less burning than takes place in available containers, c) a package which in addition to providing satisfactory popping is also foldable into a size not much larger overall than the total volume of the corn, fat and salt thereby allowing the package to be shipped efficiently at low cost and to be dispensed from commercially available vending equipment, d) a package which will effectively reduce the number of unpopped kernels by providing greater popping efficiency for a given charge of corn and fat and specifically to increase by 12% or more the popped volume that can be obtained with the same charge of corn, fat and salt popped in an ordinary paper bag using a microwave oven of about 400 watts to 700 watts capacity.

THE FIGURES

SUMMARY OF THE INVENTION

Figure 2:
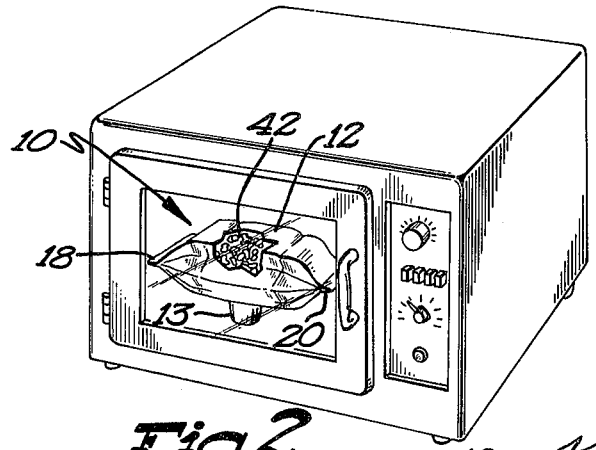
FIG. 2 is a perspective view of the package of FIG. 1 as it appears after being popped in a microwave oven.

The invention provides a package for shipping and popping popcorn comprising a dual compartmented container. One of the compartments is relatively small and holds a charge of unpopped corn. A second compartment is relatively large in size and functions to hold the corn after popping except that which remains in the first compartment. The corn is propelled as it pops by the force of the explosion from the small compartment through an opening between the two compartments into the large compartment. The compartments thus communicate through the opening that serves as a passage for the corn as it pops.

The small compartment normally serves as the bottom or base which supports the container during popping. It is preferably about the same size as the charge or slightly larger and is formed from a self supporting semi-rigid material. Paperboard or plastic sheet are examples. The lower surface of the base is formed to allow the package to rest on a horizontal surface with the large compartment at the top. The small compartment is preferably provided with obliquely oriented side walls which are inclined inwardly proceeding from the top to the bottom thereof so that the bottom of the small compartment is smaller in cross-section than its top. The small compartment can thus be thought of as funnel shaped. The large compartment is preferably flexible and expandable. Expansion can be carried out either manually before popping or as a result of gas and steam generated by the corn and preferably by both. The large compartment preferably includes portions which are expandable. These portions are initially folded to a relatively small volume so that the size of the entire container is preferably not much larger than the volume of popcorn and any other food substances used with the popcorn such as fat and salt. The upper compartment is preferably provided with pleats, folds or gussets that enable it to increase many times in volume either during or before popping. It also preferably includes a quick opening means to enable it to be opened substantially its full width or length when the corn is to be served. When expanded, the large compartment has inclined lower walls that extend downwardly and centrally toward the upper edge of the small compartment so that the unpopped kernels tend to slide or roll back into the small compartment where the fat remains during popping. It was found that because of its relatively small cross-sectional area, the smaller compartment especially at its lower end functions during the popping operation as a deep reservoir for the melted fat and the unpopped kernels as they continue to slide back into the melted fat have a much greater opportunity to pop. Accordingly, the popped volume of the corn prepared in the present package is substantially greater than it is when the fat is allowed to spread out as a thin layer over a large area, for example, the side of a paper bag laid horizontally in the oven prior to popping. It was also found that the funnel shape of the small compartment helps to prevent popped kernels from jamming inside it.

DETAILED DESCRIPTION

Figure 1:
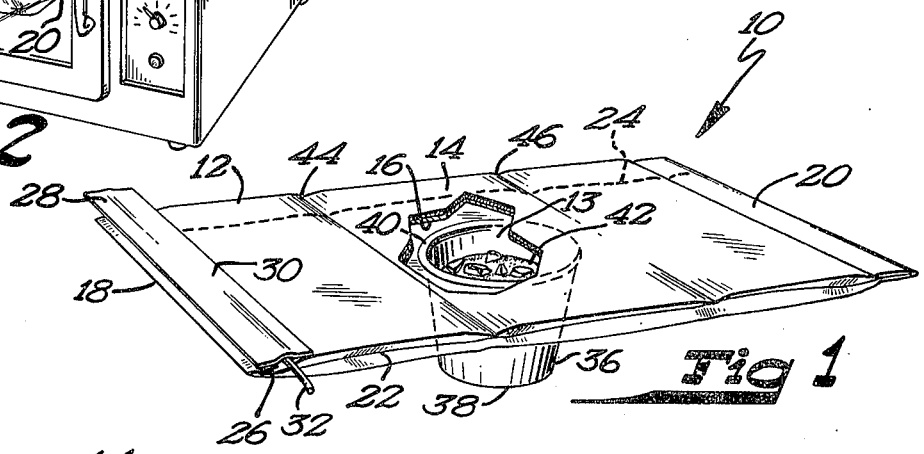
FIG. 1 is a perspective view of a package embodying the invention.

In FIGS. 1 and 2 is shown an embodiment of the invention wherein the package designated 10 comprises a gussetted paper bag 12 having the usual flat rectangular side walls which are shown in a horizontal position in the drawing, the upper wall of which includes two plys 14 and 16 to provide a degree of grease resistance. The inner ply 14 can, for example, be a layer of glasine paper or the like to provide the required grease resistance and prevent the outer surface of the package from having a spotty oily appearance after popping. Another suitable bag material is a laminate of 25 lb./ream bleached kraft paper bonded with a layer of 1 mill polyethylene type film to a layer of 25 lb./ream kraft paper meeting paper industry standards of grease proofness. In general, however, the bag 12 can be formed from any sturdy grade of flexible cellulosic material and is preferably transparent to microwave energy.

It will be seen that the bag 12 defines a relatively large chamber or compartment. A second relatively small compartment 13 also preferably formed from a cellulosic material but in this case a semi-rigid material such as paperboard communicates with the large compartment through an opening and serves as a storage container for the unpopped corn together with fat, flavoring and the like. The bag 12 is sealed at its left end without the use of glue or paste by folding the cut end of the bag downwardly at 18 thereby securely retaining the ends of the gussets 22 and 24 in place. After the end has been folded down at 18, the downwardly folded edge of the bag 26 is secured in place by a tape 28 which has an end 28a that extends beyond the side edge of the bag. One portion 30 of the tape 28 is sealed to the part of the bag immediately adjacent to the fold 18. The other end of the bag is folded over at 20 and securely pasted shut. In this way the tape 28 holds the end of the bag shut. To open, a rip string 32 is bonded to the center of the tape and extends longitudinally of the tape 28 to that by pulling on the string 32 manually one can rip the tape along its length allowing the end 18 of the bag to be quickly opened substantially its full width when the popped corn is to be served.

The lower compartment of the package includes a sloped circular sidewall 36 secured to the bag at its upper ends by means of a lip 34. The lip 34 is suitable bonded to the bag as by means of paste or tape within a circular opening 40 provided in the lower wall of the bag 12. The compartment 13 thus communicates freely with the inside of the bag 12. The compartment 13 is preferably formed from material such as paperboard that is heavier than paper and can be thought of as semi-rigid since it is self-supporting but bendable. The paperboard can have the approximate weight of a paper cup or a paper ice cream carton and should have a high degree of grease and moisture proofness. Compartment 13 should be transparent to microwave energy but the bag 12 can, if desired, be composed of one or more layers of flexible sheet material that is not transparent to microwave energy e.g. aluminum foil to shield the popcorn and thereby reduce heating after it is popped. The inclined sidewall 36 of the compartment 13 gives the compartment a generally funnel shaped configuration. The bottom wall of the compartment 13 is indicated at 38. The corn together with fat and salt is located as shown at 42 within compartment 13 prior to popping i.e., during shipment and storage. One preferred fat is hydrogenated coconut oil. While the amounts of materials can be varied, one preferred formula is approximately 14 parts corn, about 5 parts fat and about 1 part salt by weight. The salt should be finely ground.

Fold lines 44 and 46 are provided transversely of the bag which allows the left and right hand ends to be folded centrally on top of one another to reduce the size of the package to approximately that of the charge of corn and fat contained therein. This substantially lessens the volume of the package and reduces shipping costs. It also makes the package more practical for use in available vending machines.

When the package is to be used, it is to be removed from storage e.g. in a vending machine, unfolded along lines 44 and 46 to the position shown in FIG. 1 with the bottom 38 of compartment 13 functioning as a base. It is then placed in a microwave oven in an upright position as shown in FIG. 2 and the oven is started. The popping time is usually about 4–7 minutes. The other end of the bag is folded over at 20 and securely pasted shut.

Figure 3:
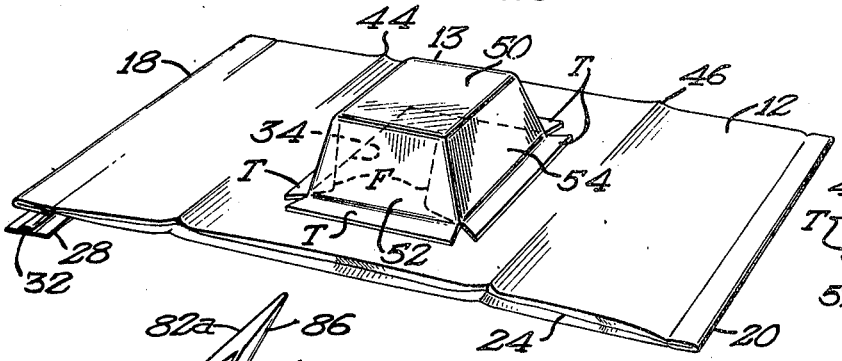
FIG. 3 is a perspective bottom view of another form of the invention.
Figure 4:
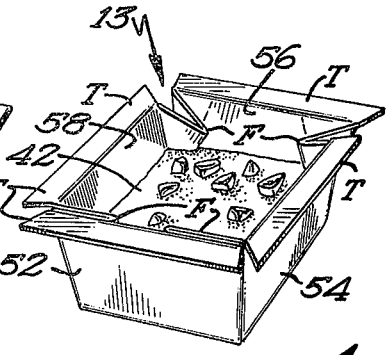
FIG. 4 is a perspective view of the popcorn storage compartment of FIG. 3 as it appears when removed from the package.
Figure 5:
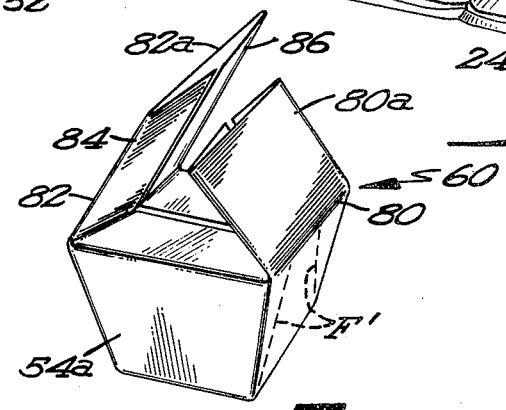
FIG. 5 is a perspective view of another form of the invention as it appears slightly unfolded from its configuration during shipping.
Figure 6:
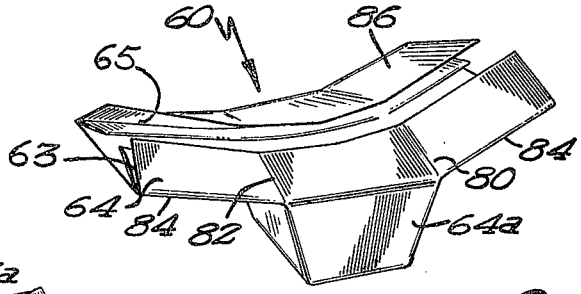
FIG. 6 is a view with the top portion of the container unfolded somewhat further than illustrated in FIG. 5.

Refer now to FIGS. 3 and 4 which illustrate another embodiment of the invention in which the small compartment has a rectangular horizontal cross-section. In this embodiment, the bag 12 is identical with that of FIGS. 1 and 2 and the same numbers will refer to corresponding parts. The storage compartment for the corn which is somewhat different will now be described.

The storage compartment 13 of FIGS. 3 and 4 is formed from a single sheet of material which is transparent to microwave energy. In this instance the sheet comprises a cellulosic material such as paperboard which is preferably relatively heavy compared with the gauge of the flexible material of the bag 12 to keep its contents from being crushed during shipment. If the compartment 13 is made of paperboard, 10–14 gauge board is suitable but is by no means critical. The compartment 13 includes a bottom wall 50 that serves as a supporting base, four side walls 52, 54, 56 and 58 which are inclined centrally proceeding toward the bottom thereof when the container is in an upright position as seen in FIG. 4 giving the compartment 13 the funnel shaped configuration. The upper edge of each of the side panels 52–58 is provided with a horizontally extending relatively narrow tab T that is pasted to the mating portion of the lower wall of bag 12 adjacent to an opening 34 which in this instance is rectangular and corresponds in size and shape to the upper edge of the compartment 13. Excess material between walls 52–58 is tucked in to form web folds F which are preferably pasted to walls 56 and 52. The charge of corn and fat 42 is the same described above.

The container of FIGS. 3 and 4 is used in the same manner as that of FIGS. 1 and 2. After being unfolded on lines 44 and 46 it is placed in an upright position with the bottom wall 50 of the compartment 13 downwardly to serve as a supporting base. It is placed in a microwave oven and cooked about 7 minutes or until the corn is popped.

Refer now to FIGS. 5 through 10 which illustrate a third embodiment of the invention.

The container of FIGS. 5 to 10 is generally similar to that of FIGS. 1 through 4, the primary difference being that the small chamber used for storing the corn during shipment is integral with the bottom wall of the larger chamber. As seen in the figures, the container indicated generally at 60 is provided with a relatively large expansible chamber at the top, the upper aspect of which is defined by a wall 62 formed from flexible sheet material such as paper e.g. kraft paper having longitudinally extending folds, pleats or gussets 63*a* and 63*b,* only the one nearest the observer 63*b* being seen in FIGS. 9 and 10. It is these gussets which allow the upper chamber of the package to expand to the condition shown in FIG. 10 as will be described below.

The upper sheet 62 is bonded around its entire periphery as shown at 65 to a lower, generally rectangular sheet 64 which forms the lower or bottom portion of the container. The charge 72 of popcorn and fat is stored in a relatively small compartment 64a which is integral with the lower sheet 64 and comprises four inclined side walls S between which are centrally projecting integral folds F′ and a bottom wall 66. The sheet 62 is preferably lighter in weight than the lower sheet 64 and can for example be 20–30 lb./ream grease resistant paper. One suitable material is a 25 lb./ream kraft paper laminated to a layer of grease proof paper with a layer of 1 mil polyethylene. The sheets 62 and 64 are cut transversely on their right ends at 68 and at their left ends at 70 to define the ends of the upper expansible portion of the container. The seal 65 at each end 68 and 70 extends up into all of the folds which define the gussets 63*a* and 63*b* thereby forming a substantially gas proof seal both to prevent contamination of the food product during shipping and to help trap gas during expansion of the package.

Before the package is placed in the oven, the upper sheet 62 is elevated at its center manually by means of a lifting tab 73. A small amount of air which leaks into the package as the tab is lifted will cause the package to assume approximately the condition shown in FIG. 9. The package is then ready to place in the oven and this is done by placing the lower surface 66 in the compartment 64*a* on the bottom of the oven and the compartment defined by sheet 64 and 62 uppermost.

Figure 8:
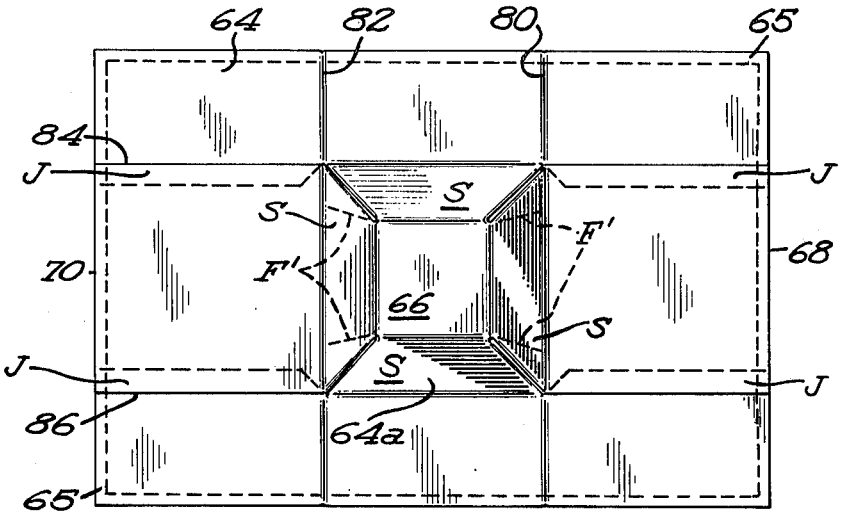
FIG. 8 is a bottom view of the container of FIGS. 5–10.
Figure 9:
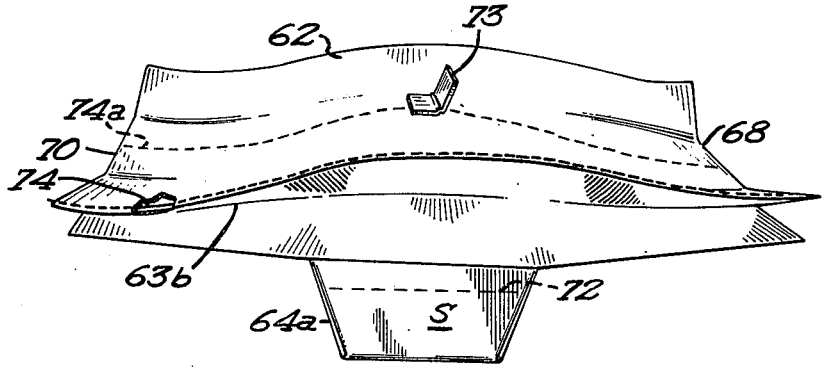
FIG. 9 is a perspective view of the container of FIGS. 5 through 10 after the erecting tab has been pulled to partially expand the upper compartment of the container.
Figure 10:
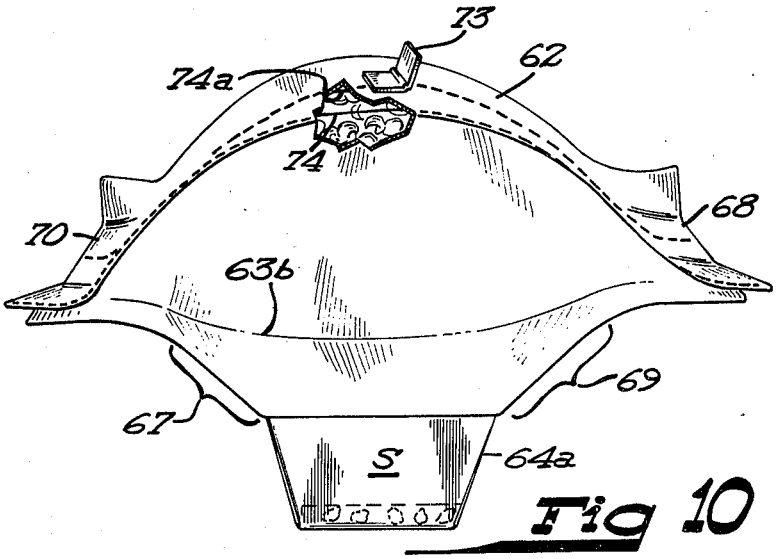
FIG. 10 is a perspective view of the package of FIGS. 5 through 10 after popping.

As seen in FIG. 8, which illustrates the package from the bottom, portions of the sheet 64 have been cut away and removed and with the edges of the cut-out sections being sealed together by longitudinally extending joints J that extend toward the ends 68 and 70 from the upper edge of the folds F′. Transversely extending fold lines 80 and 82 enable the sides of the package to be folded centrally along the upper edges of the receptacles 64*a.* When the upper expandable portion of a package is folded inwardly along fold lines 80 and 82 until the flaps 80*a* and 82*a* are against the top of the package 64*a,* the whole package is not much larger than the volume of corn and fat contained therein. This facilitates shipment and lowers storage costs. Fold lines 84 and 86 also extend at right angles to folds 80, 82 to enable the laterally extending portions of the package to be folded centrally so that the package appears as in FIG. 6.

Figure 7:
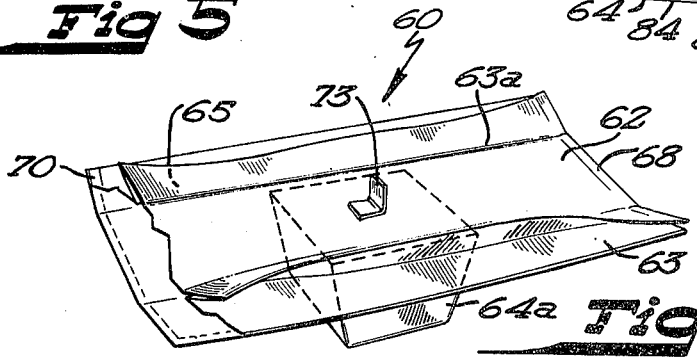
FIG. 7 is a perspective view of the package of FIGS. 5–10 with the expandable upper container fully unfolded.

Prior to popping, the flaps 80*a* and 82*a* are folded outwardly at 80, 82 and 84, 86 so that the package as a whole appears as shown in FIG. 7. Tab 73 is then lifted as described above to expand the large compartment of the package. As can be best seen in FIG. 10, the lower surfaces 67 and 69 of the sheet 64 are inclined upwardly and outwardly proceeding from the upper edges of the compartment 64*a.* These inclined surfaces appear to function as a slide or chute and help to assure that any unpopped kernels of corn thrown up out of the compartment 64*a* will slide back into the compartment 64*a* and fall into the heated fat 70 where they will be more likely to pop probably because the hot fat appears to promote heat transfer to the kernels.

The angle of the sloped sides of the small compartment is not considered critical but some degree of slope has been found useful in preventing the popped kernels from becoming jammed in the small compartment. An angle of as little as 4° or 5° from the vertical will produce some benefit but the angle is typically between about 10° and 35° to the vertical with about 20°–30° being preferred.

What is claimed is:

1. A double compartmented combined popping and shipping package for popcorn comprising a supporting base including a first semi-rigid compartment having side and bottom walls and a second flexible compartment communicating therewith and having first and second parallel sheets of flexible material defining the upper and lower surfaces thereof, said first and second sheets being connected together at their edges and expansion pleats in the sheets to allow expansion of the second compartment, said second compartment being located outside the walls of the first compartment and supported at the upper end of the first compartment to define the top of the package and being of sufficient size after popping to hold all of said popcorn after it has popped except that which remains in the first compartment, said second compartment being larger than the first compartment.

2. The package of claim 1 wherein both of the compartments are formed from cellulosic sheet material.

3. The package of claim 1 wherein at least a portion of the large compartment is formed from a material that is not transparent to microwave energy to thereby at least partially shield the corn after it is popped.

4. A combined popping and shipping package for popcorn comprising a charge of unpopped corn, a relatively small compartment having side and bottom walls holding the unpopped corn and being on the order of the same size as the charge and a larger compartment separate and distinct from the small compartment having a pair of opposed connected walls and said larger compartment being connected to the small compartment on opposite sides of an opening and communicating therewith through said opening, whereby the large compartment receives the corn as it pops, the large compartment is a collapsed paper bag sealed at its ends and having longitudinally extending gussets to facilitate expansion thereof to accomodate popped kernels.

5. The package of claim 4 wherein the small compartment is formed from semi-rigid flexible sheet material.

6. The package of claim 5 wherein the semi-rigid sheet material is paperboard.

7. The package of claim 4 wherein one side of the bag has a hole therein smaller in size than the distance between said ends of the bag and the edges of the hole are connected to the small compartment to define the communication therebetween.

8. A combined popping and shipping package for popcorn comprising a two compartmented container defined by a first relatively small compartment of a substantially fixed volume containing unpopped corn and a second relatively large compartment separate and distinct from the first compartment and communicating with the small compartment through an opening, the compartments being connected together adjacent to and on opposite sides of said opening whereby the corn when it pops is propelled by the force of the popping explosions from the small compartment to the large compartment, the small compartment is formed from semi-rigid cellulosic sheet material and is funnel shaped, the end most remote from the large compartment is formed to act as a supporting base and the large compartment comprises upper and lower rectangular sheets connected together at their edges and pleats are provided in the large compartment to permit expansion of the upper and lower rectangular sheets.

* * * * *